US007971562B2

(12) United States Patent
Choi et al.

(10) Patent No.: US 7,971,562 B2
(45) Date of Patent: Jul. 5, 2011

(54) CONTINUOUS VARIABLE VALVE LIFT DEVICE

(75) Inventors: Myungsik Choi, Seoul (KR); Kyoung Pyo Ha, Suwon-si (KR); Chun Woo Lee, Suwon-si (KR); Woo Tae Kim, Suwon-si (KR); Hyung Ick Kim, Gunpo-si (KR); Yooshin Cho, Seoul (KR); Ingee Suh, Yongin-si (KR); Back Sik Kim, Osan-si (KR); Dae Sung Kim, Hwaseong-si (KR); Dae Yoon Oh, Ann Arbor, MI (US); Dong Hee Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 377 days.

(21) Appl. No.: 12/205,461

(22) Filed: Sep. 5, 2008

(65) Prior Publication Data

US 2009/0255496 A1 Oct. 15, 2009

(30) Foreign Application Priority Data

Apr. 14, 2008 (KR) ..... 10-2008-0034299

(51) Int. Cl.
*F01L 1/34* (2006.01)

(52) U.S. Cl. ..... 123/90.16; 123/90.48

(58) Field of Classification Search ..... 123/90.16, 123/90.48, 90.52

See application file for complete search history.

(56) References Cited

U.S. PATENT DOCUMENTS

| | | | | |
|---|---|---|---|---|
| 4,723,515 | A * | 2/1988 | Burandt | 123/90.16 |
| 5,235,942 | A * | 8/1993 | Olmr | 123/90.27 |
| 2007/0151534 | A1 * | 7/2007 | Cecur et al. | 123/90.48 |

* cited by examiner

*Primary Examiner* — Zelalem Eshete

(74) *Attorney, Agent, or Firm* — Morgan, Lewis & Bockius LLP

(57) ABSTRACT

A continuous variable valve lift device includes a valve, which opens/closes a channel by means of reciprocation, a control shaft, which is mounted so as to be able to move toward or away from a reciprocation central axis of the valve, a pivotable shoe, which is pivotably coupled to the control shaft, includes a cam insertion part in a recess or through-hole shape and a slide face slidably contacting an end of the valve, and reciprocates the valve when pivoted, and a drive cam, which comes into contact with an inner wall of the cam insertion part, and pivots the pivotable shoe. Thereby, the continuous variable valve lift device can freely adjust a lift amount and a lift time of the valve without changing positions of the drive cam and camshaft, and thus be easily applied to an existing engine.

17 Claims, 5 Drawing Sheets

CONTINUOUS VARIABLE VALVE LIFT DEVICE

CLAIM OF PRIORITY

This application claims the benefit of Korean Patent Application No. 10-2008-0034299 filed on Apr. 14, 2008, in the Korean Intellectual Property Office, the disclosure of which is incorporated herein by reference.

BACKGROUND OF THE INVENTION

1. Field of the Invention

The present invention relates to a continuous variable valve lift device, in which a valve has simultaneously variable lift time and distance depending on the low-/high-speed operating range of an engine, and more particularly to a continuous variable valve lift device, in which additional components for conducting variable lifting of a valve are minimized, thereby providing a more simple structure.

2. Description of the Related Art

As for an engine, a camshaft is rotated by a rotating force transmitted from a crank shaft, and an intake valve and an exhaust valve are reciprocated up and down with regular timing by cams of the camshaft. Thereby, intake air is supplied to a combustion chamber, and then combustion gas is exhausted. In this process, a fuel-air mixture is compressed and exploded to generate power.

In this manner, a series of elements such as a drive cam, a camshaft, a tappet, a rocker arm, etc. for operating the intake and exhaust valves is called a valve train.

In a conventional art, a valve is installed on an intake or exhaust port in a cylinder head through a valve guide. A spring support plate is installed on a cylinder head body. A valve spring is installed between the spring support plate and a spring retainer. A tappet of the valve is installed so as to contact a drive cam.

The ordinary valve train configured in this way repeats the operation in which the drive cam rotates to push the valve tappet to open the valve while compressing the valve spring, and then the valve is closed by a recovery force of the valve spring.

However, this ordinary valve train makes a single degree-of-freedom system motion by motion of the cam, so that it is impossible to change the valve train depending on engine operation conditions such as high-speed and low-speed engine operation conditions.

In order to solve this problem, there have been developed a variety of continuous variable valve lift devices, each of which is adapted to adjust a lift time and a lift distance of the valve according to the engine speed. However, these continuous variable valve lift devices must change positions of the drive cam and the camshaft, so that it is impossible to easily apply them to existing mass-produced engines.

Further, these continuous variable valve lift devices are designed to adjust the lift time of the valve by increasing or decreasing the lift distance of the valve, so that it is impossible to more efficiently adjust the lift time of the valve.

In addition, the continuous variable valve lift devices additionally require a separate variable cam in addition to the drive cam coupled to the camshaft in order to adjust the lift distance and the lift time of the valve, so that they have complicated internal configuration.

SUMMARY OF THE INVENTION

The present invention has been made to solve the foregoing problems with the prior art, and therefore the present invention is directed to a continuous variable valve lift device, capable of being easily applied to existing mass-produced engines without changing position a drive cam and a camshaft, and minimizing additional components such as a variable cam, and thereby making it possible to simplify and miniaturize internal configuration.

According to an aspect of the invention, there is provided a continuous variable valve lift device, which includes a valve, which opens/closes a channel by means of reciprocation; a control shaft, which is mounted so as to be able to move toward or away from a reciprocation central axis of the valve; a pivotable shoe, which is pivotably coupled to the control shaft, includes a cam insertion part in a recess or through-hole shape and a slide face slidably contacting an end of the valve, and reciprocates the valve when pivoted; and a drive cam, which comes into contact with an inner wall of the cam insertion part, and pivots the pivotable shoe.

Here, the slide face may include a zero lift section, a low lift section, and a high lift section, wherein the zero lift section does not pivot a rocker arm when the slide face is in contact with the valve, and the low and high lift sections lift the valve at different distances.

The pivotable shoe may further include a lift activation portion disposed on the cam insertion part, wherein the lift activation portion placed in a range of the low lift section protrudes inwards and is activated by the cam lobe of the drive cam to shift the zero lift section, the low lift section, and the high lift section of the slide face according to rotation of the drive cam.

Meanwhile, the continuous variable valve lift device may further include a return spring, which applies an elastic force to the pivotable shoe such that the inner wall of the cam insertion part is in close contact with the drive cam.

Further, the valve may include a tappet, which has a bulged curved face contacting the slide face slide face, at the end thereof.

Also, the control shaft may move along a curved path so as to have the center of curvature equal to that of the curved face of the tappet.

In addition, the continuous variable valve lift device may further include a shaft block having a guide slot. The guide slot may be curved so as to have a center of curvature equal to that of the curved face of the tappet, wherein the control shaft passes through the guide slot to slide along the guide slot.

According to the present invention, the continuous variable valve lift device can freely adjust the lift time and the lift distance of the valve without changing positions of the drive cam and the camshaft, and thus be easily applied to existing mass-produced engines. Further, the continuous variable valve lift device can reduce additional components required to adjust the lift time and the lift distance of the valve, and thus make internal configuration compact and simple.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EXEMPLARY EMBODIMENT

The present invention will now be described more fully hereinafter with reference to the accompanying drawings, in which exemplary embodiments thereof are shown. In the following description of the present invention, a detailed description of known functions and components incorporated herein will be omitted when it may make the subject matter of the present invention rather unclear.

Figure 1:
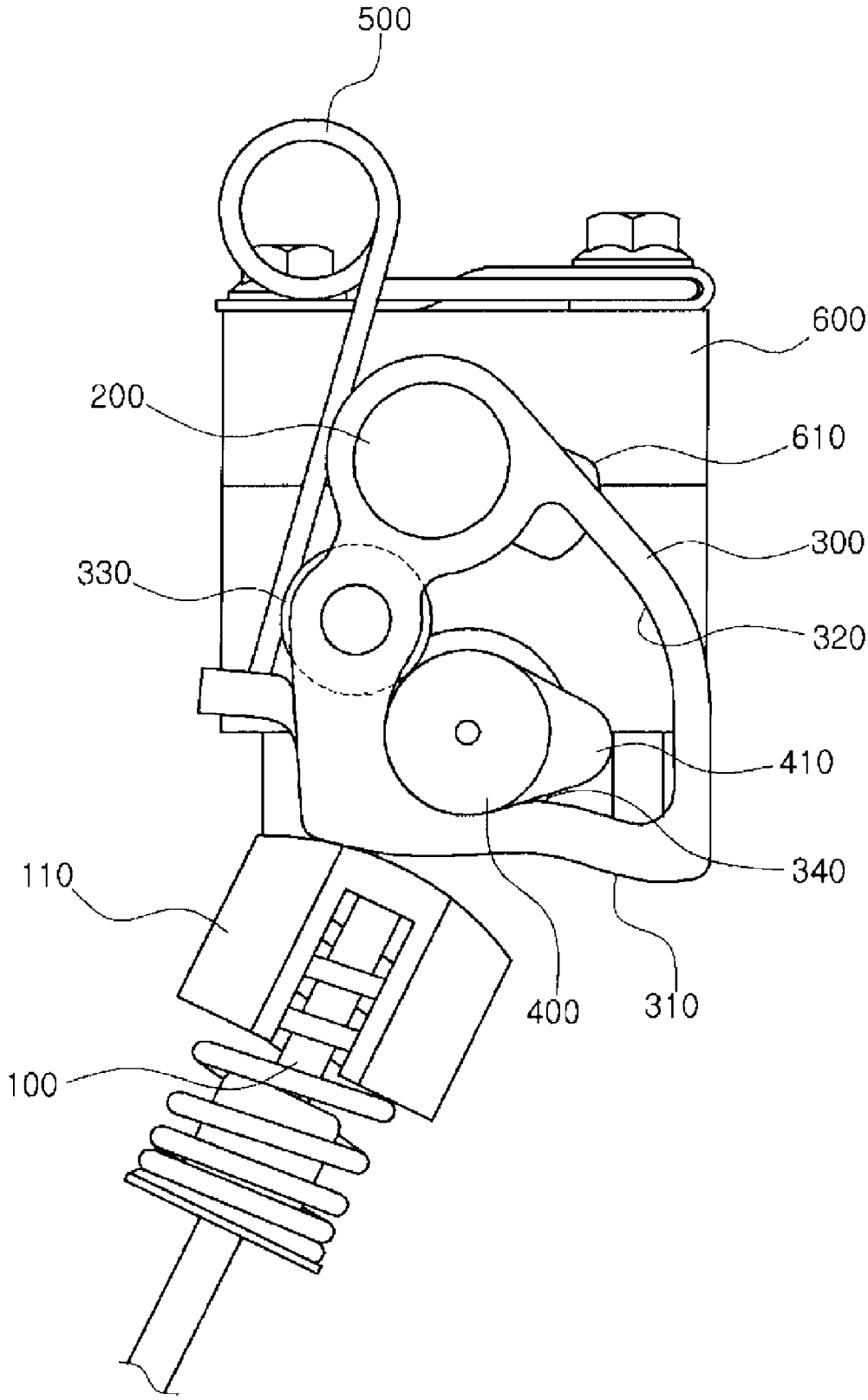
FIG. 1 is a schematic view illustrating the structure of a continuous variable valve lift device in a low lift state according to an exemplary embodiment of the present invention.
Figure 2:
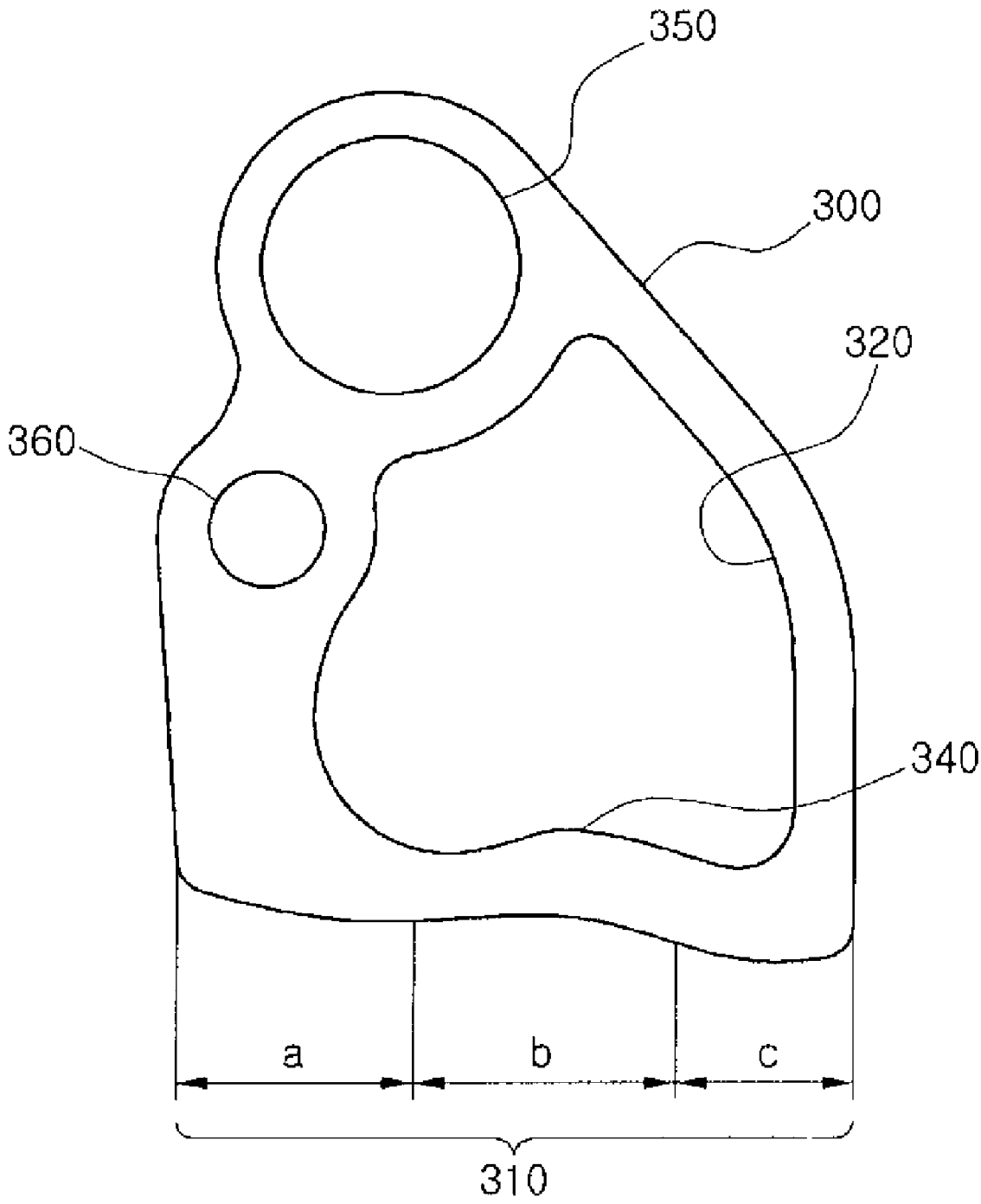
FIG. 2 illustrates a pivotable shoe for a continuous variable valve lift device according to an exemplary embodiment of the present invention.

FIG. 1 is a schematic view illustrating the structure of a continuous variable valve lift device according to an exemplary embodiment of the present invention, and FIG. 2 illustrates a pivotable shoe for a continuous variable valve lift device according to an exemplary embodiment of the present invention.

As illustrated in FIG. 1, the continuous variable valve lift device according to an exemplary embodiment of the present invention includes a valve 100, which opens or closes a channel by means of longitudinal reciprocation thereof, a control shaft 200, which is controlled to move toward or away from a reciprocation central axis of the valve 100, a pivotable shoe 300, which is pivotably coupled to the control shaft 200 and reciprocates the valve 100 when pivoted, and a drive cam 400, which pivots the pivotable shoe 300 with respect to the control shaft 200.

Unlike an ordinary continuous variable valve lift device, the continuous variable valve lift device according to an exemplary embodiment of the present invention has a distinctive feature in that the drive cam 400 is mounted on an inner side rather than on one side of the pivotable shoe 300 so as to be able to press an outer surface of the pivotable shoe 300 by contacting the inner side of the pivotable shoe 300, so that an entire device can be made compact.

In order to make this coupling structure possible, the pivotable shoe 300 is provided, substantially at a central part thereof, with a cam insertion part 320 in the shape of a through-hole extending in the longitudinal direction of the control shaft 200. An outer circumference of the drive cam 400 is configured to come into contact with a portion of an inner wall of the cam insertion hole 320. In this manner, since the through-hole is formed in the pivotable shoe 300, the drive cam 400 applying a driving force can be mounted in the pivotable shoe 300, so that the entire device can be made compact. Further, since a member having a through-hole has a value of moment of inertia greater than that of a through-hole-free member having the same cross section, the durability of the pivotable shoe 320 is increased.

Although this embodiment has described that the cam insertion part 320 is formed only in the through-hole shape, the shape of the cam insertion part 320 is not limited to the through-hole shape. Thus, as long as the inner wall of the cam insertion part 320 can be in contact with a portion of the outer circumference of the drive cam 400, the shape of the cam insertion part 320 can be replaced by any shape. For example, the cam insertion part 320 may have the shape of a recess with a depth in the longitudinal direction of the control shaft 200.

In an exemplary embodiment of the present invention, the control shaft 200 can be rotatably mounted to a shaft block 600 as shown in FIG. 1. Further, the continuous variable valve lift device may further include a return spring 500, wherein one end of the return spring 500 is connected to the shaft block 660 and the other end of the return spring 500 is slidably coupled to the pivotable shoe 330. Accordingly the return spring 500 applies an elastic force to the pivotable shoe 300 such that the inner wall of the cam insertion part 320 is always in contact with a portion of the outer circumference of the drive cam 400 regardless of pivoting of the pivotable shoe 300 and rotation of the drive cam 400.

Also, the pivotable shoe 300 includes a slide face 310, which slidably contacts an upper face of the tappet 110, on one side thereof (i.e. a lower side thereof in FIG. 1) opposite a side where the control shaft 200 is mounted. As illustrated in FIG. 2, the slide face 310 is divided into three sections, i.e., a zero lift section a, a low lift section b, and a high lift section c, wherein the zero lift section does not provide lift to the valve 100 when the zero lift section of the slide face 310 is in contact with the valve 100, but the low and high lift sections b and c provide lift to the valve 100 at different distances.

In other words, the valve 100 is not lowered within the zero lift section a of the slide face 310, is lowered by a relative short distance within the low lift section b, and is lowered by a relative long distance within the high lift section c. At this time, lengths and shapes of the zero lift section a, the low lift section b, and the high lift section c can be appropriately varied on various conditions such as a distance and an angle between the control shaft 200 and the valve 100, a distance and an angle between the control shaft 200 and the drive cam 400, and a setup distance by which the valve 100 must be lowered, and so on.

Referring to FIG. 2, the pivotable shoe 300 further comprises shaft holes 350 and 360, and a lift activation portion 340. Through the shaft hole 350, the control shaft 200 is coupled to the shaft block 600. The shaft hole 360 is to couple a roller 330 to the pivotable shoe 300 as explained later. The lift activation portion 340 is disposed within the range of the low lift section b and protrudes inwards from a portion of the cam insertion hole 320. The lift activation portion 340 changes the mode between the low life state and the high lift state as explained later in detail.

Further, the tappet 100 of the valve 100 has high corrosion resistance, at an end thereof (i.e. an upper end thereof in FIG. 1) which comes into contact with the slide face 310. In an exemplary embodiment of the present invention, an upper end face of the tappet 110, i.e. a face that contacts the slide face 310 of the pivotable shoe 300, is machined by crowning so as to have a spherical radius. This crowning is for avoiding an extreme edge contact by causing a contact between the drive cam 400 and the tappet 110 to lie between a line contact and a point contact.

This configuration, in which the valve 100 has the tappet 110 with the bulged face at the end thereof, is widely used for a conventional valve train, and so a detailed description thereof will be omitted.

The control shaft 200 functions as a pivoting center of the pivotable shoe 300. Accordingly, by shifting the control shaft 200, the pivoting center of the pivotable shoe 300 is changed, thereby adjusting a lift distance of the valve 100.

At this time, if the normal vector of moving locus of the control shaft 200 is not in parallel to the normal vector of the curved upper face of the tappet 110, the operation in which the slide face 310 is spaced apart from and comes into contact with the curved upper face of the tappet 110 may be repeated, thereby causing noise as well as damage to each component.

For this reason, the control shaft 200 is configured to move along a curved path having the same center of curvature as that of the curved upper face of the tappet 110 so as to allow the curved upper face of the tappet 110 to be in contact with the slide face 310 of the pivotable shoe 300 at all times. From this configuration, the normal vector of moving locus of the control shaft 200 becomes in parallel to the normal vector of the curved upper face of the tappet 110.

Although the control shaft 200 can be configured to independently move without a separate guide means, in this case, there is a possibility of the control shaft 200 to deviate from a regular path due to impact applied from the outside. Thus, as illustrated in FIG. 1, the control shaft 200 is configured to be coupled to a guide slot 610 formed in the shaft block 600 so as to slidably move along the guide slot 610. The guide slot 610 may be preferably formed in a curved shape having the same center of curvature as the curved upper face of the tappet 110.

One end of the guide slot 610 is configured to be positioned substantially near to or on the reciprocation central axis of the valve 100 and the other end of the guide slot 610 is offset with a predetermined angle from the reciprocation central axis with respect to a rotation center of the drive cam.

Hereinafter, operations of the low lift and high lift modes will be explained.

Figure 3:
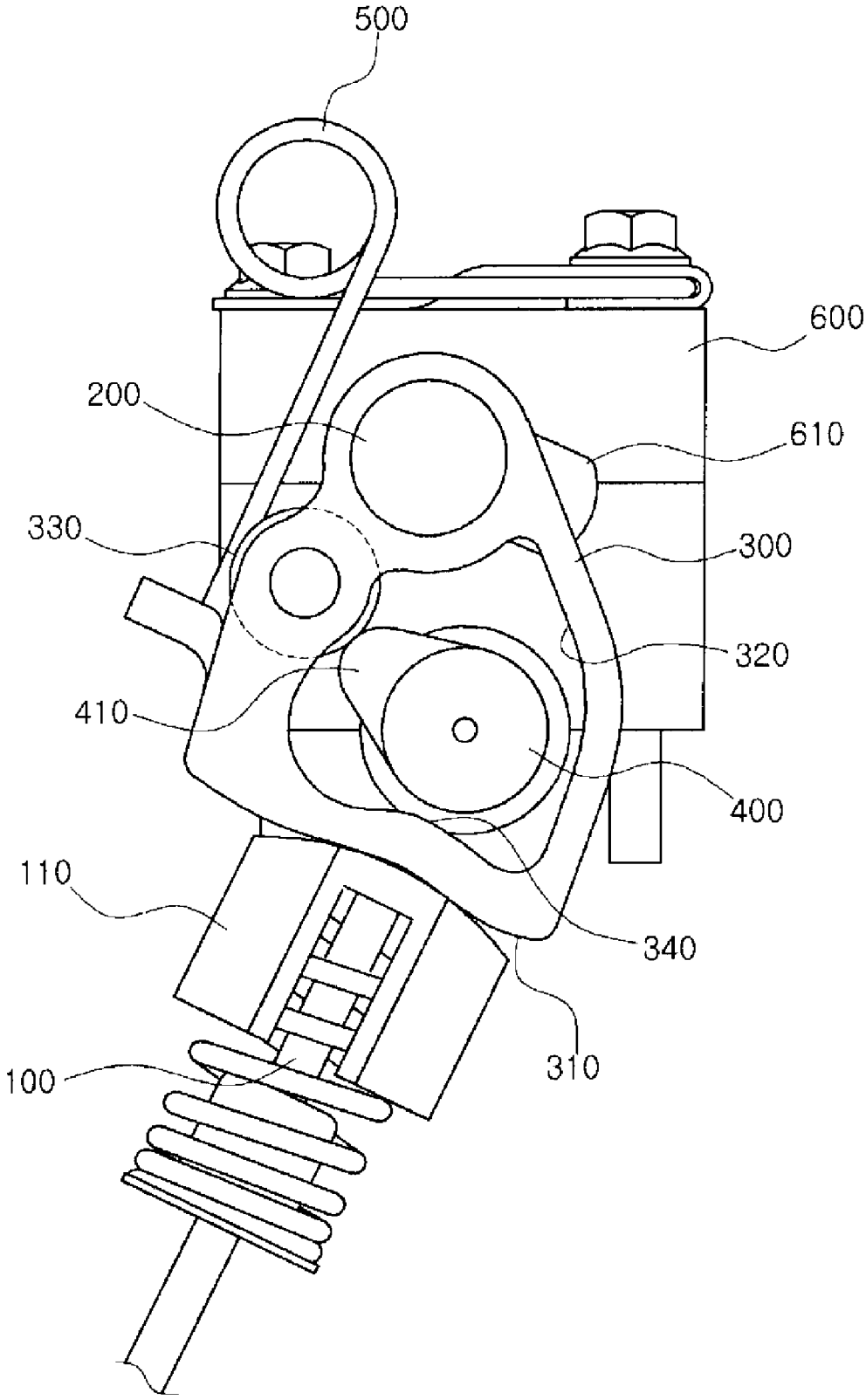
FIG. 3 is a schematic view illustrating the structure of a continuous variable valve lift device, a valve of which is in a low lift state, according to an exemplary embodiment of the present invention.

FIGS. 1 and 3 are schematic views illustrating the structure of a continuous variable valve lift device, a valve of which is in a low lift state, according to an exemplary embodiment of the present invention.

As illustrated in FIGS. 1 and 3, in the low lift mode, the control shaft 200 is located at a left-hand end of the guide slot 610 in the drawing. That is to say, the rotation center of the control shaft 200 is offset with a predetermined angle with respect to the rotation center of the drive cam 400 from the reciprocation central axis of the valve 100.

FIG. 1 illustrates a case that there is no lift in the low lift mode, wherein the zero lift section a of the slide face 310 is in contact with the curved upper face of the tappet 110. However once the drive cam 400 rotates clockwise to bring a cam lobe 410 into contact with the lift activation portion 340 formed in the inner wall of the cam insertion part 320, the cam lobe 410 pushes the activation portion 340 of the pivotable shoe 300 in the left direction in the drawing, and thus the pivotable shoe 300 pivots around the control shaft 200. From this operation, the zero lift section a of the pivotable shoe 300 slidably moves in the left direction along the curved upper face of the tappet 110 and thus the low lift section b comes in contact with the curved upper face of the tappet 110 as illustrated in FIG. 3. As a result, the tappet 110 and the valve 100 are pushed downwards by the low lift section b of the slide face 310.

As a result, when the control shaft 200 is located at a left-hand end of the guide slot 610 in the drawing, the curved upper face of the tappet 110 comes into contact with the slide face 310 only within the low lift section b despite of maximum pivoting of the pivotable shoe 300, and thus the valve 100 is lowered at a relatively short distance. In other words, when the valve 100 moves in a downward direction as illustrated in FIG. 3, the valve 100 is in the low lift state in which it slightly opens the channel.

Meanwhile, if the cam lobe 410 is configured to be in direct contact with the pivotable shoe 300, there is a possibility of causing noise due to a frictional force or hindering smooth rotation. As such, the pivotable shoe 300 may be preferably provided with a roller 330 at a portion where it contacts the cam lobe 410. The roller 300 is coupled to the pivotable shoe 300 through the shaft hole 360.

Figure 4:
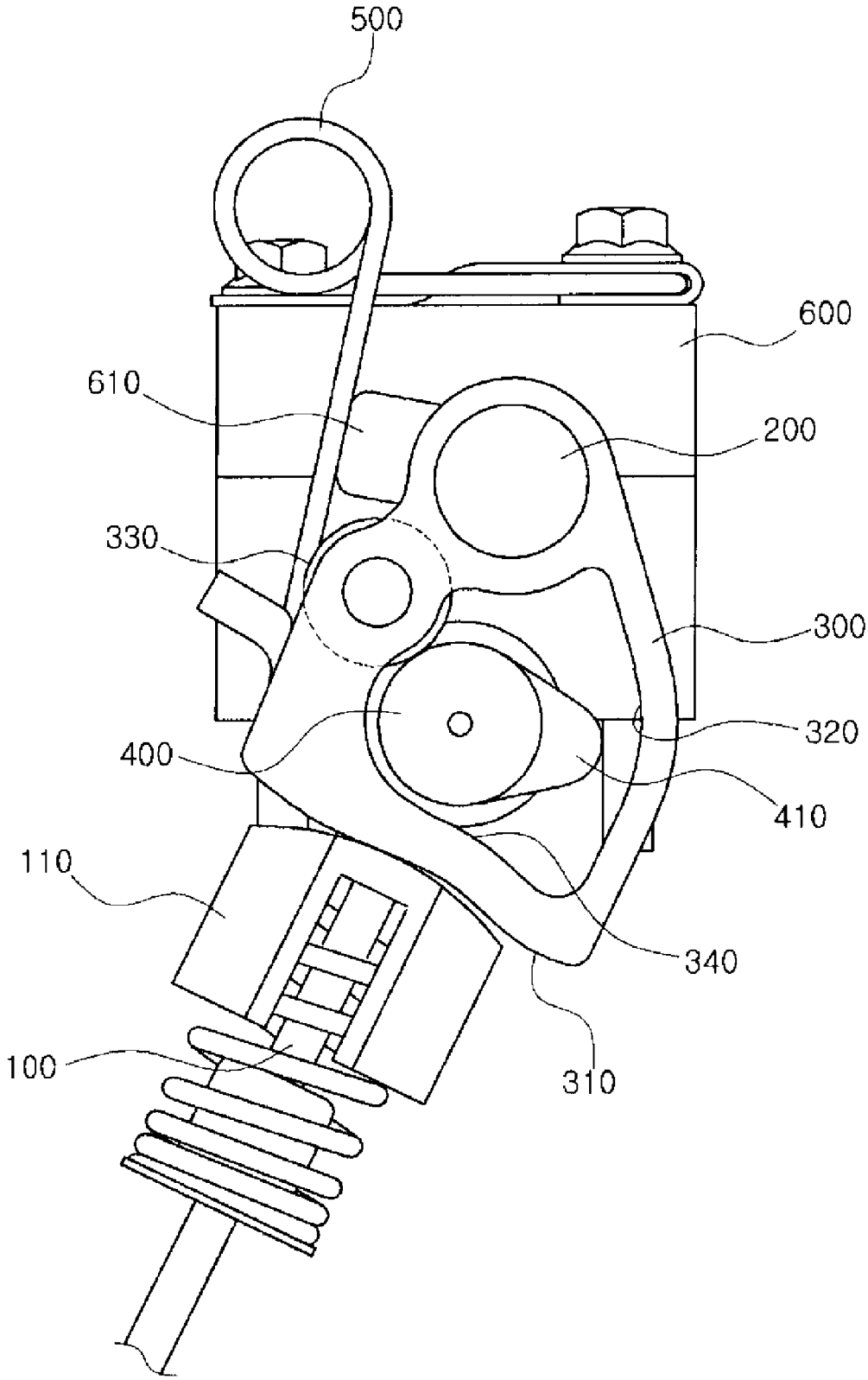
FIGS. 4 and 5 are schematic views illustrating the structure of a continuous variable valve lift device, a valve of which is in a high lift state, according to an exemplary embodiment of the present invention.
Figure 5:
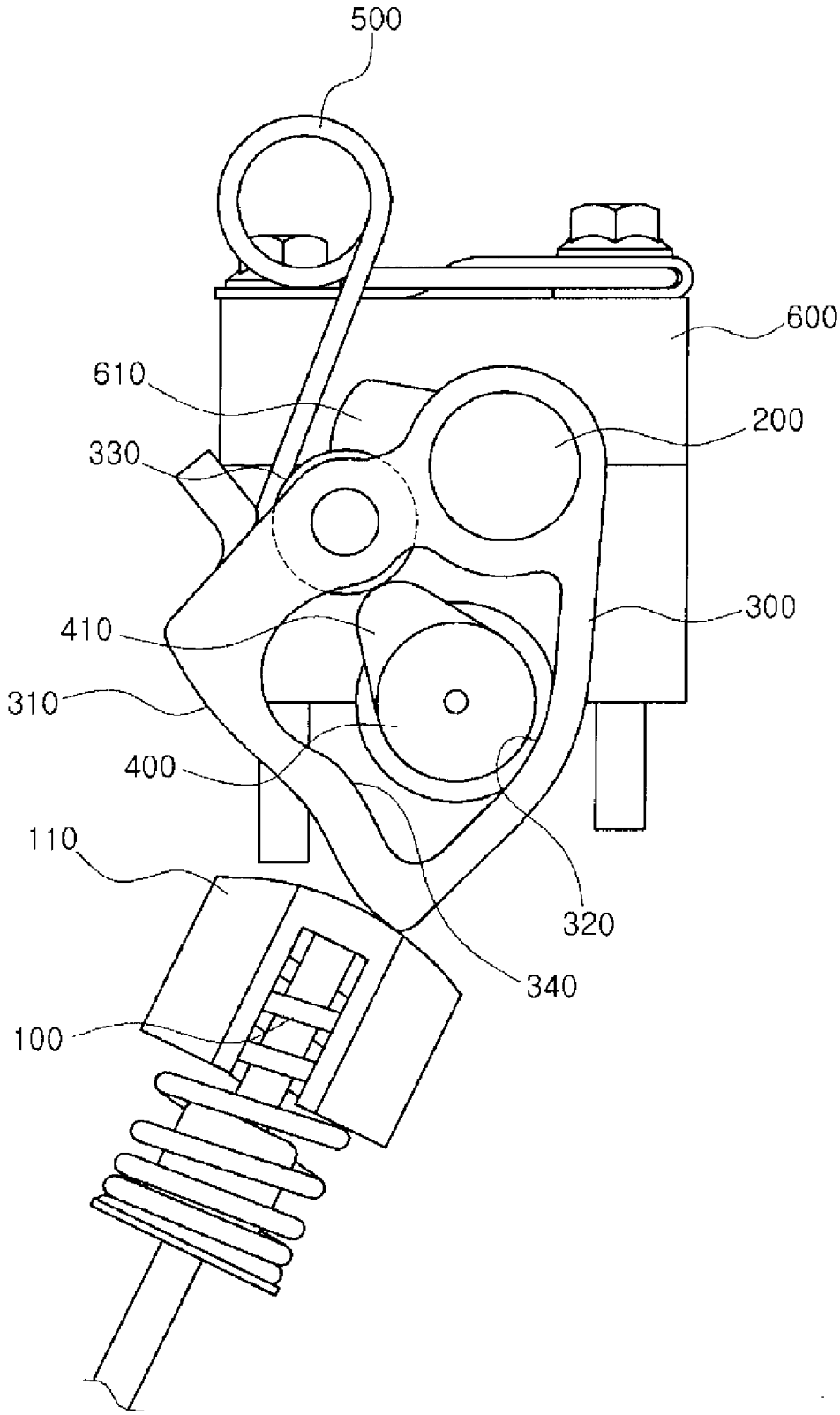

FIGS. 4 and 5 are schematic views illustrating the structure of a continuous variable valve lift device, a valve of which is in a high lift state, according to an exemplary embodiment of the present invention.

As illustrated in FIGS. 4 and 5, the control shaft 200 is controlled to move to a right-hand end of the guide slot 610 in the drawing. The right-end of the guide slot 610 is positioned on or near to the reciprocation central axis of the valve 100.

After a low lift state of the continuous variable valve lift device as illustrated in FIG. 1, when the control shaft 200 is controlled to move toward the right-hand side of the guide slot 610 in the drawing, the pivotable shoe 300 is rotated in a clockwise direction with respect to the drive cam 400. However, the curved upper face of the tappet 110 is still located within the low lift section b as illustrated in FIG. 4. In other words, even when the pivotable shoe 300 is rotated with respect to the drive cam 400 in a clockwise direction, the tappet 110 and the valve 100 can be pushed downwards by the slide face 310.

The low lift section b may be preferably formed so as to have a curvature greater than that of the zero lift section a such that the curved upper face of the tappet 110 can ride on and slide along the slide face 310 toward the low lift section b when the lift activation portion 340 is pushed in the left direction by the cam lobe 410 of the drive cam 400 as explained hereinafter.

As illustrated in FIG. 5, once the drive cam 400 rotates clockwise to bring a cam lobe 410 into contact with the lift activation portion 340 formed in the inner wall of the cam insertion part 320, the cam lobe 410 pushes the activation portion 340 of the pivotable shoe 300 in the left direction in the drawing, and thus the pivotable shoe 300 pivots around the control shaft 200 clockwise. From this operation, the low lift section b of the pivotable shoe 300 slidably moves in the left direction along the curved upper face of the tappet 110 and thus the high lift section c comes in contact with the curved upper face of the tappet 110.

As a result, the tappet 110 and the valve 100 are pushed downwards by the high lift section c of the slide face 310 as shown in FIG. 5 and thus the tappet 110 and the valve 100 are further lowered compared to the state as illustrated in FIG. 3. In other words, when the valve 100 is lowered as illustrated in FIG. 5, the valve 100 is in the high lift state in which it opens the channel to the maximum extent.

In this manner, the continuous variable valve lift device according to the present invention can freely adjust lift amount and a lift time of the valve 100 without using a separate variable cam, so that it can made compact and simple.

Although this embodiment has described only the structure in which the tappet 110 is mounted on the upper end of the valve 100 and is pressed by the pivotable shoe 300 so as to open/close the valve 100, this structure may be changed into the structure in which the rocker arm is mounted on the upper end of the valve 100 and is pressed by the pivotable shoe 300 so as to open/close the valve 100.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

What is claimed is:

1. A continuous variable valve lift device, comprising:

a valve, which opens or closes a channel by reciprocation thereof;

a control shaft configured to be controlled to move toward or away from a reciprocation central axis of the valve;

a pivotable shoe pivotably coupled to the control shaft, the pivotable shoe including:

a cam insertion part formed of a recess or through-hole shape; and a slide face slidably contacting an end portion of the valve, and reciprocating the valve when the pivotable shoe is pivoted; and a drive cam comprising a cam lobe, wherein the drive cam is disposed in the cam insertion part, contacts an inner wall of the cam insertion part, and pivots the pivotable shoe around the control shaft;

wherein the slide face formed on an external circumference of the pivotable shoe includes a zero lift section, a low lift section, and a high lift section in series, the zero lift section not pivoting the pivotable shoe, and the low and high lift sections lifting the valve at different distances according to pivoting of the pivotable shoe and rotation of the drive cam.

2. The continuous variable valve lift device according to claim 1, wherein the pivotable shoe further includes a lift activation portion disposed on the cam insertion part, the lift activation portion placed in a range of the low lift section and protruding inwards and activated by the cam lobe of the drive cam to shift the zero lift section, the low lift section, and the high lift section of the slide face according to rotation of the drive cam.

3. The continuous variable valve lift device according to claim 2, wherein the valve includes a tappet, which has a bulged curved face contacting the slide face, at the end thereof.

4. The continuous variable valve lift device according to claim 3, wherein the control shaft moves along a path configured to have a center of curvature substantially equal to that of the curved face of the tappet.

5. The continuous variable valve lift device according to claim 4, further comprising a shaft block having a guide slot configured to have a center of curvature equal to that of the curved face of the tappet, wherein the control shaft coupled to the pivotable shoe passes through the guide slot and is controlled to slide along the guide slot.

6. The continuous variable valve lift device according to claim 5, wherein one end of the guide slot is configured to be positioned substantially near to or on the reciprocation central axis of the valve and the other end of the guide slot is configured to be spaced with a predetermined distance from the reciprocation central axis.

7. The continuous variable valve lift device according to claim 1, wherein the valve includes a tappet, which has a bulged curved face contacting the slide face, at the end thereof.

8. The continuous variable valve lift device according to claim 7, wherein the control shaft moves along a path configured to have a center of curvature equal to that of the curved face of the tappet.

9. The continuous variable valve lift device according to claim 8, further comprising a shaft block having a guide slot configured to have a center of curvature substantially equal to that of the curved face of the tappet, wherein the control shaft coupled to the pivotable shoe passes through the guide slot and is controlled to slide along the guide slot.

10. The continuous variable valve lift device according to claim 2, wherein the drive cam is disposed substantially on the reciprocation central axis of the valve and the valve includes a tappet, which has a bulged curved face contacting the slide face, at the end thereof.

11. The continuous variable valve lift device according to claim 10, further comprising a shaft block having a guide slot configured to have a center of curvature substantially equal to that of the curved face of the tappet, wherein the control shaft coupled to the pivotable shoe passes through the guide slot and is controlled to slide along the guide slot.

12. The continuous variable valve lift device according to claim 11, wherein one end of the guide slot is configured to be positioned substantially near to or on the reciprocation central axis of the valve and the other end of the guide slot is configured to be distanced with a predetermined angle from the reciprocation central axis with respect to the drive cam.

13. The continuous variable valve lift device according to claim 12, wherein one end of a return spring is connected to the shaft block and the other end of the return spring is slidably coupled to the pivotable shoe.

14. A continuous variable valve lift device, comprising:

a valve, which opens or closes a channel by reciprocation thereof;

a control shaft configured to be controlled to move toward or away from a reciprocation central axis of the valve;

a pivotable shoe pivotably coupled to the control shaft, the pivotable shoe including:

a cam insertion part formed of a recess or through-hole shape; and a slide face slidably contacting an end portion of the valve, and reciprocating the valve when the pivotable shoe is pivoted; and a drive cam comprising a cam lobe, wherein the drive cam is disposed in the cam insertion part, contacts an inner wall of the cam insertion part, and pivots the pivotable shoe around the control shaft; and a return spring, which applies an elastic force to the pivotable shoe such that inner wall of the cam insertion part is in close contact with the drive cam;

wherein the valve includes a tappet, which has a bulged curved face contacting the slide face, at the end thereof; and wherein the control shaft moves along a path configured to have a center of curvature substantially equal to that of the curved face of the tappet.

15. The continuous variable valve lift device according to claim 14, further comprising a shaft block having a guide slot configured to have a center of curvature substantially equal to that of the curved face of the tappet, wherein the control shaft coupled to the pivotable shoe passes through the guide slot and is controlled to slide along the guide slot.

16. The continuous variable valve lift device according to claim 15, wherein one end of the guide slot is configured to be positioned substantially near to or on the reciprocation central axis of the valve and the other end of the guide slot is configured to be spaced with a predetermined distance from the reciprocation central axis.

17. The continuous variable valve lift device according to claim 15, wherein one end of the return spring is connected to the shaft block and the other end of the return spring is slidably coupled to the pivotable shoe.

* * * * *